US005520089A

United States Patent [19]

Prentiss

[11] Patent Number: 5,520,089

[45] Date of Patent: May 28, 1996

[54] WATER ORGAN

[76] Inventor: John G. Prentiss, P.O. Box 15458, Santa Fe, N.M. 87506-5458

[21] Appl. No.: 321,738

[22] Filed: Oct. 12, 1994

[51] Int. Cl.[6] ..... G10D 7/00; G10D 13/08

[52] U.S. Cl. ..... 84/330; 84/402; 84/410

[58] Field of Search ..... 84/330, 402, 410, 84/83, 84, 331

[56] References Cited

U.S. PATENT DOCUMENTS 465,487 12/1891 Munch ..... 84/402

3,715,949 2/1973 Takeuchi ..... 84/330

3,748,945 7/1973 Kramer ..... 84/330

4,217,807 8/1980 Nutting et al. ..... 84/402

*Primary Examiner*—Cassandra C. Spyrou

[57] ABSTRACT

A musical instrument wherein water is selectively injected into an array of resonant air columns, of varied resonant frequency. When the injected water impacts with the closed end of the air columns, vibrations are excited having a pitch resonant with the respective air column and possessing musical quality. By selectively controlling the flow stream, the user may play a musical composition having a distinctly aqueous character.

1 Claim, 1 Drawing Sheet

WATER ORGAN

FIELD OF INVENTION

This invention pertains to musical instruments wherein the tones produced are emitted from the excitation of resonant air columns of varying dimension as in a pipe organ, but wherein the vibrational excitation is initiated by hydraulic means.

BACKGROUND OF INVENTION

The pneumatic organ, most commonly found in churches and cathedrals, is driven by compressed air passing through orifices specially designed to vibrate the air in a varied array of tuned resonant columns thereby producing a plurality of musical tones. Control is generally accomplished by means of a keyboard and foot pedals linked to mechanical or electromechanical pneumatic valves regulating air flow to each air column. This type of instrument may be quite complex and is capable of producing clear, precise tones with a high degree of control, much the same as a piano, but with a distinctly pneumatic character. A second form of instrument somewhat akin to the subject invention is the aeolian harp, a stringed instrument played by turbulent air flow wherein the selection of notes is not governed by human control.

SUMMARY OF INVENTION

The concept of the water organ arises from the basic principle of vibrating air in tuned resonant columns to produce musical tones. However, the subject invention employs liquid as the primary means to excite a varied array of harmonically tuned air columns. The tones produced thereby embody an essence distinctly different from conventional forms of music.

The object of the invention is to produce by hydraulic excitation a plurality of aqueous tones which may be selectively played in a comprehensive format. The resulting tones may encompass a range from powerfully dynamic to extremely soothing, with a unique nature that can only be attained by hydraulic means. The water organ can be equipped with mechanical or electromechanical controls to precisely regulate hydraulic flow to the individual resonant columns as in the pneumatic organ, thereby making it possible to play a musical composition. In a more basic form, it may be designed to play random tones through turbulent flow of the source, thereby imitating the spirit of the aeolian harp.

DETAILED DESCRIPTION

Figure 1:
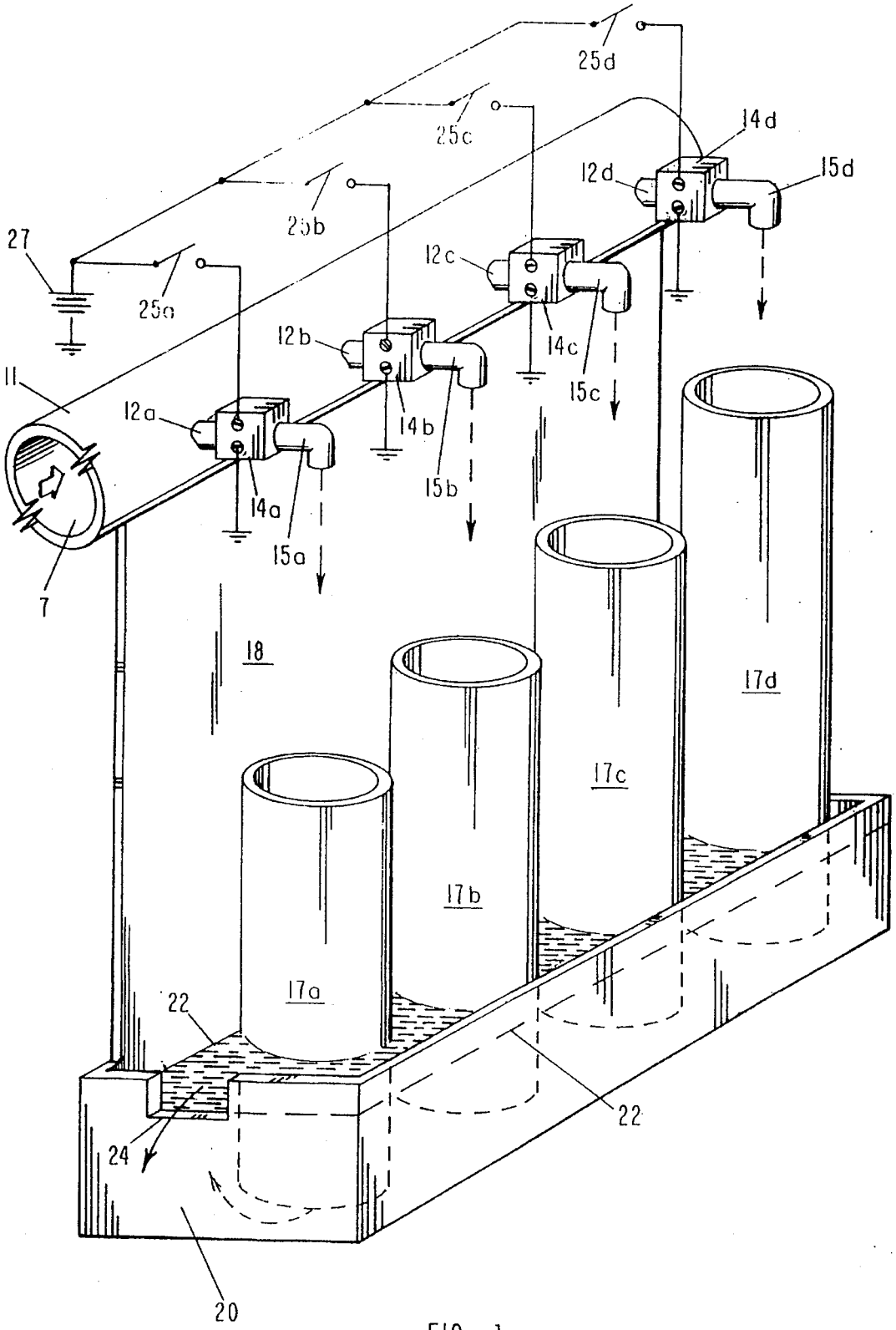
FIG. 1 is a perspective of a very basic embodiment showing the essential elements of the invention.

Now referring to FIG. 1, a water supply port 7 leads directly into a distribution manifold 11 having a plurality of outlet ports 12*a–d*. As with the air supply in a pneumatic organ, water availability must be adequate to supply the maximum number of outlet ports that may be desired to be opened simultaneously during operation of the instrument. Control valves may be electromechanical, those shown being a plurality of spring closing solenoid valves 14*a–d* which are opened when connected to the power source 27 via a corresponding plurality of switches 25*a–d*. The switching devices may be incorporated into an electronic keyboard similar to those widely in use today, thus providing the user a conventional means of control. A plurality of nozzles 15*a–d* conduct the flow directly into the center of each of a plurality of tuned resonant air columns 17*a–d*. The air columns, constructed of any suitable material such as metal, plastic, ceramics, glass, masonry or wood, are constructed to varying lengths according to well known vibrational dynamics of resonant air columns. In general terms, a short air column will emit a short frequency or high pitch while a long air column will emit a long frequency or low pitch. A wide range of tones may be attained by creating an array of appropriately sized air columns much as in the art of pneumatic organ construction.

In the embodiment shown, the resonant air columns 17*a–d* are constructed of hollow tubes, open at both ends, the lower end being immersed in a watertight, level reservoir 20 to a point below the water line 22. Access is left at the bottom of the tube for water to freely pass from the tube to the reservoir, thereby maintaining a relatively constant level at the base of the interior air columns 17*a–d*. The reservoir 20 is fitted with an outlet port 24 through which water may freely drain off, thereby maintaining a relatively constant water level 22 overall. A support means 18 is provided to elevate the manifold assembly in proper position above the air columns 17*a–d*.

In operation, an adequate supply of any suitable liquid, preferably water, flows into the instrument at entry port 7 and is thereafter distributed through manifold 11 to a plurality of ports 12*a–d*. The flow is selectively controlled in this embodiment by a plurality of electromechanical valves 14*a–d* which independently release water when activated by corresponding switches 25*a–d*, wired in parallel to power source 27. The flow thereafter passes through nozzles 15*a–d* which inject the flow into the resonant air columns 17*a–d* at the open ends. The flow impacts centrally with the water at the immersed ends of the tubes. Each column 17*a*, 17*b*, 17*c*, and 17*d* is made a different length, thereby resonating a different frequency and emitting a different tone.

In this embodiment, wherein the air columns 17*a–d* are constructed of tubes open at both ends, the lower ends are immersed in reservoir 20 below water line 22 to hydraulically terminate the air columns at the desired resonant frequency. This configuration further provides a liquid point of impact for the falling water thereby generating a strong vibration that is resonated by the column above. The length of the resonant columns 17*a–d* is maintained by virtue of the fact that water flows freely from the bases of the air columns and out the outlet port 24. Selectively operating switches 25*a–d*, a musical composition having a distinctly aqueous quality may be played.

In the interest of clarity, the embodiment shown is very limited in scope. However, it can be readily seen that the invention may be expanded to encompass a far wider range of tones by adding more resonant air columns and their related drive assemblies. It seems further obvious that the flow may be governed by mechanical as well as electromechanical means, and that, in addition to a keyboard, note selection may be accomplished by means of a computer program, piano roll or music box-type device—a simple task for one skilled in the art. In place of a distribution manifold, a plurality of independently controlled pumps may be used. A single re-circulating pump is envisioned, as well as the use of electronic pick ups, amplification, and other embellishments.

The subject of this invention is neither the state of the art of the control means nor the well known art of excitation of resonant air columns of varying length to produce music. Rather it is the use of hydraulic means to excite a plurality of tuned resonant air columns that makes this invention unique. The liquid tones and hydraulic drumming produced by the subject invention will enable a wide range of aqueous music to be played in compositions never before heard. Therefore the foregoing embodiment is intended to primarily illustrate the essentials of the subject invention and should not be construed to limit the range of possibility as more broadly defined in the appended claims and their legal equivalents.

I claim:

1. A musical instrument for producing a plurality of tones comprising:

a plurality of resonant air columns, each having an opening;

water source means for providing a volume of flow of water;

water distribution means for selectively directing the volume of flow of water from the water source means into the opening in each of said plurality of resonant air column members exciting said air columns to resonate;

water outlet means for maintaining a constant water level within each of said plurality of resonant air column members while the volume of flow of water is directed therein by said water distribution means whereby each of the plurality of resonant air column members maintains a substantially constant pitch.

* * * * *